US010177439B2

(12) United States Patent
Lee et al.

(10) Patent No.: US 10,177,439 B2
(45) Date of Patent: Jan. 8, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Chih-Ho Lee, New Taipei (TW); Tun-Yuan Tsou, New Taipei (TW); Hsi-Chieh Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/655,898

(22) Filed: Jul. 21, 2017

(65) Prior Publication Data

US 2018/0026335 A1 Jan. 25, 2018

Related U.S. Application Data

(60) Provisional application No. 62/365,340, filed on Jul. 21, 2016.

(30) Foreign Application Priority Data

Jul. 18, 2017 (CN) ..... 2017 1 0586521

(51) Int. Cl.

| | |
|---|---|
| ***H01Q 1/24*** | (2006.01) |
| ***H01Q 13/18*** | (2006.01) |
| ***H01Q 5/50*** | (2015.01) |
| ***H01Q 1/48*** | (2006.01) |
| ***H01Q 21/28*** | (2006.01) |

(Continued)

(52) U.S. Cl.

CPC ..... *H01Q 1/242* (2013.01); *H01Q 1/243* (2013.01); *H01Q 1/48* (2013.01); *H01Q 5/314* (2015.01); *H01Q 5/371* (2015.01); *H01Q 5/50* (2015.01); *H01Q 13/18* (2013.01); *H01Q 21/28* (2013.01)

(58) Field of Classification Search

CPC ..... H01Q 13/18; H01Q 1/24; H01Q 1/242; H01Q 1/48; H01Q 5/50; H01Q 1/243; H01Q 21/28; H01Q 5/314; H01Q 5/371

See application file for complete search history.

(56) References Cited

U.S. PATENT DOCUMENTS

| | | | | |
|---|---|---|---|---|
| 4,023,179 A * | 5/1977 | Ikrath | ..... | H01Q 1/44 343/713 |
| 8,610,629 B2 * | 12/2013 | Pascolini | ..... | H01Q 1/243 343/700 MS |
| 9,331,397 B2 * | 5/2016 | Jin | ..... | H01Q 21/28 |

(Continued)

*Primary Examiner* — Tho G Phan

(74) *Attorney, Agent, or Firm* — ScienBiziP, P.C.

(57) ABSTRACT

An antenna structure includes a metallic member, a first matching circuit, and a second matching circuit. The metallic member includes a front frame, a backboard, and a side frame. The side frame defines a slot. The front frame defines a first gap and a second gap communicating with the slot and extending across the front frame. A portion of the front frame between the first gap and the second gap forms a first radiating section. One end of the first feed portion connects to the first radiating section, the other end connects to a first feed source and a second feed source through an extractor of the first matching circuit; an end of the first radiating section adjacent to the second gap connects to a ground through an third inductor and an third capacitor of the second matching circuit. A wireless communication device using the antenna structure is provided.

20 Claims, 24 Drawing Sheets

(51) Int. Cl.
*H01Q 5/314* (2015.01)
*H01Q 5/371* (2015.01)

(56) References Cited

U.S. PATENT DOCUMENTS

| | | | | |
|---|---|---|---|---|
| 9,379,427 | B2 * | 6/2016 | Xu | H01Q 1/243 |
| 9,531,059 | B2 * | 12/2016 | Iellici | H01Q 1/243 |
| 9,647,332 | B2 * | 5/2017 | Han | H01Q 1/50 |
| 9,711,841 | B2 * | 7/2017 | Yong | H01Q 1/243 |
| 2014/0139380 | A1 | 5/2014 | Ouyang et al. | |
| 2015/0372372 | A1 | 12/2015 | Lee et al. | |

* cited by examiner

ANTENNA STRUCTURE AND WIRELESS COMMUNICATION DEVICE USING SAME

CROSS-REFERENCE TO RELATED APPLICATIONS

This application claims priority to U.S. Patent Application No. 62/365,340 filed on Jul. 21, 2016, and claims priority to Chinese Patent Application No. 201710586521.3 filed on Jul. 18, 2017 the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as wireless signals in Long Term Evolution Advanced (LTE-A) frequency bands. However, when the antenna is located in the metal housing, the antenna signals are often shielded by the metal housing. This can degrade the operation of the wireless communication device. Additionally, the metallic backboard generally defines slots or/and gaps thereon, which will affect an integrity and an aesthetic of the metallic backboard.

BRIEF DESCRIPTION OF THE DRAWINGS

Implementations of the present technology will now be described, by way of example only, with reference to the attached figures.

DETAILED DESCRIPTION

Figure 1:
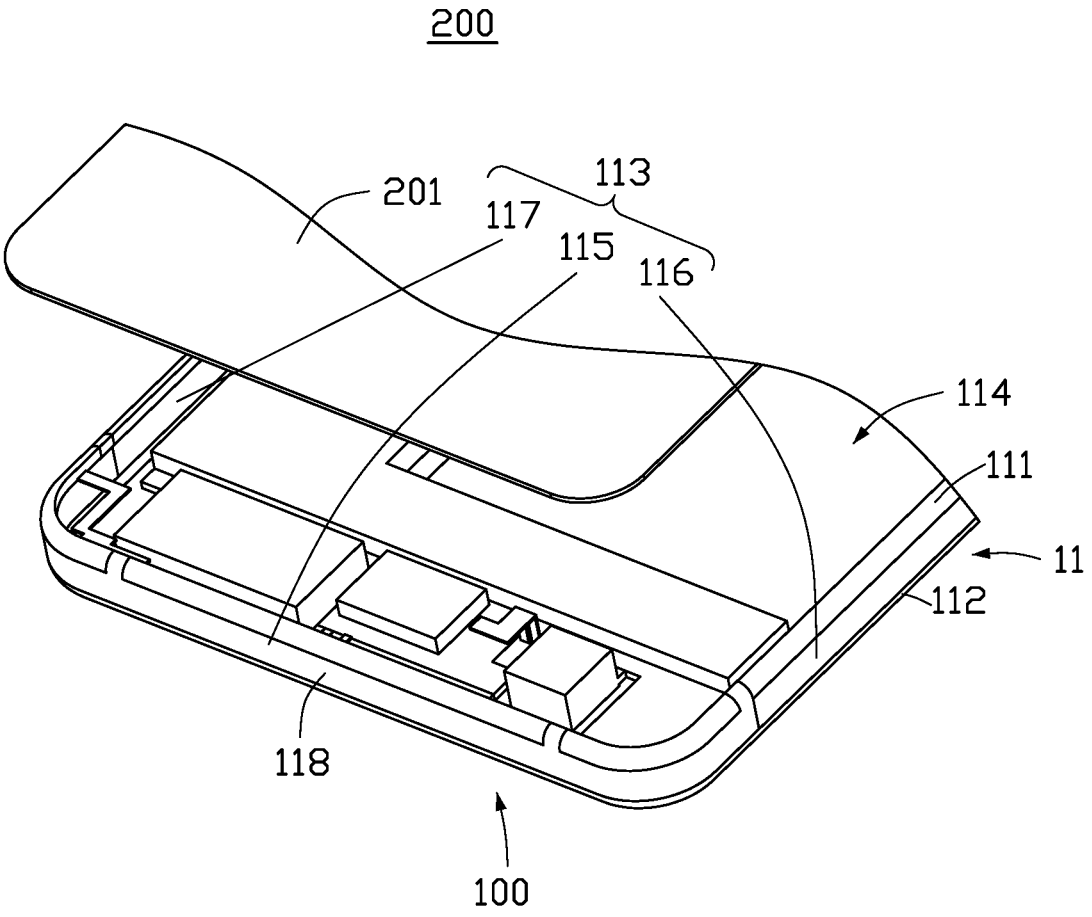
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates a first embodiment of a wireless communication device 200 using a first exemplary antenna structure 100. The wireless communication device 200 can be a mobile phone or a personal digital assistant, for example. The antenna structure 100 can receive or send wireless signals.

Figure 2:
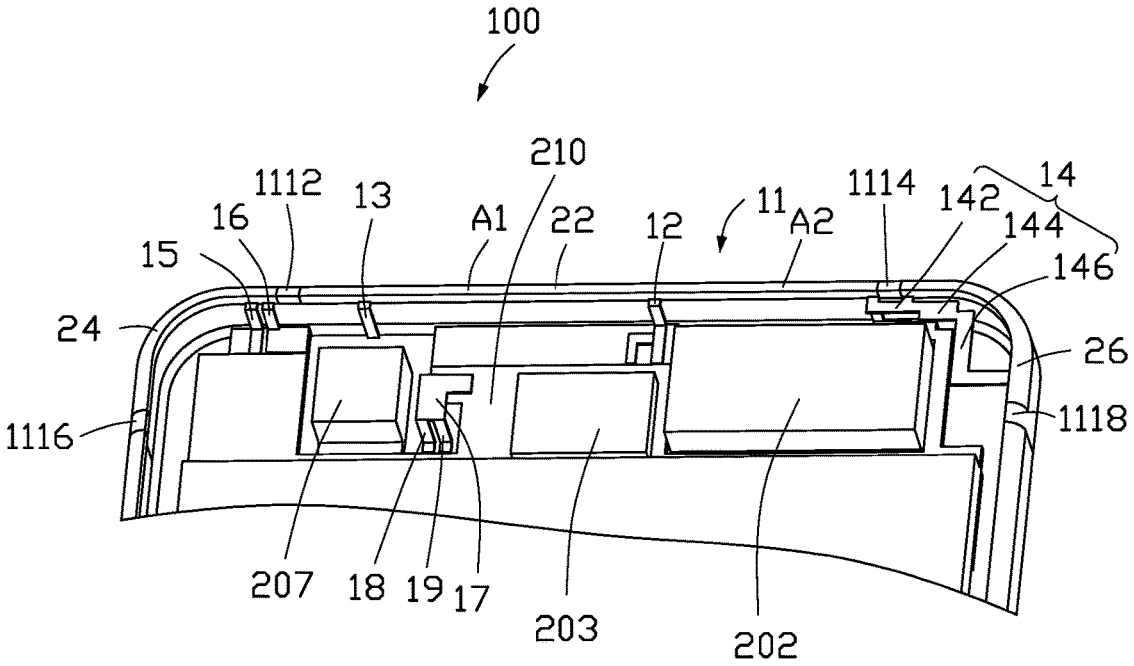
FIG. 2 is an assembled, isometric view of the wireless communication device of FIG. 1.
Figure 3:
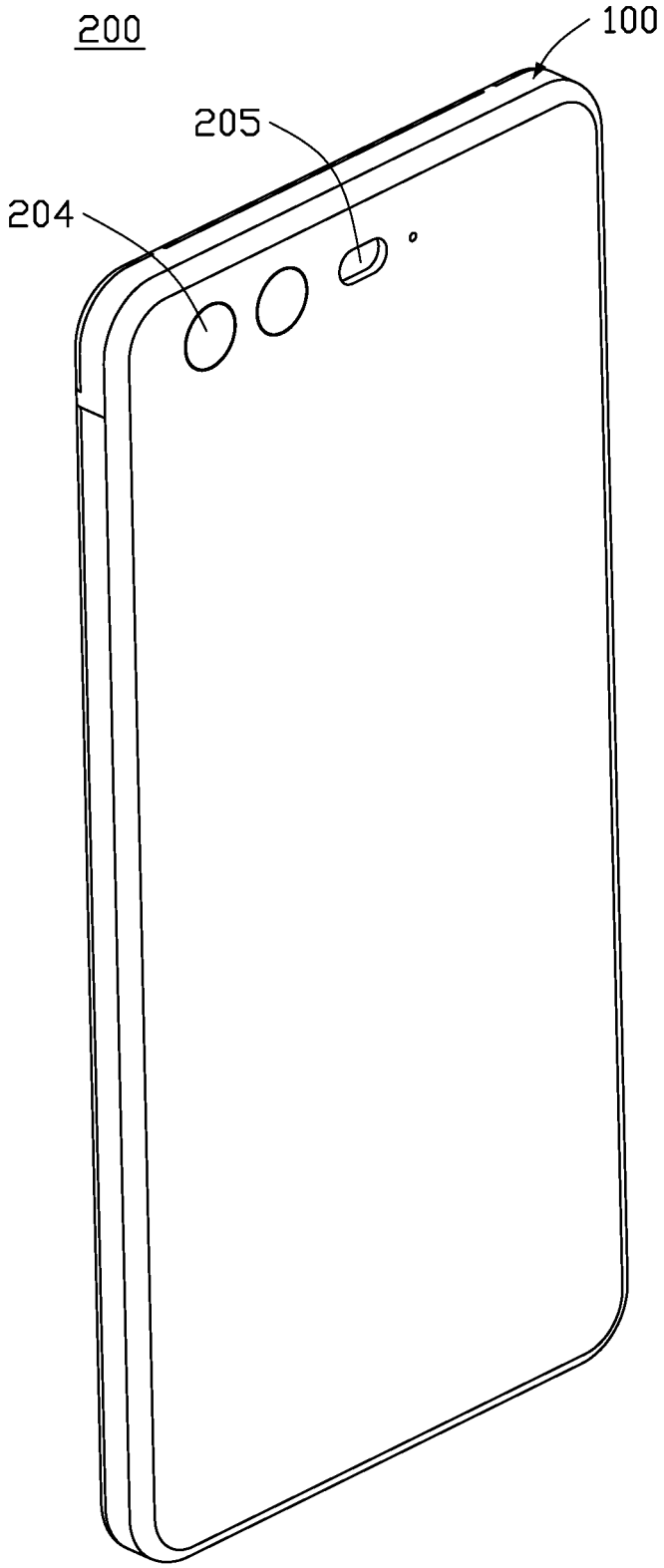
FIG. 3 is similar to FIG. 1, but shown in another angle.
Figure 5:
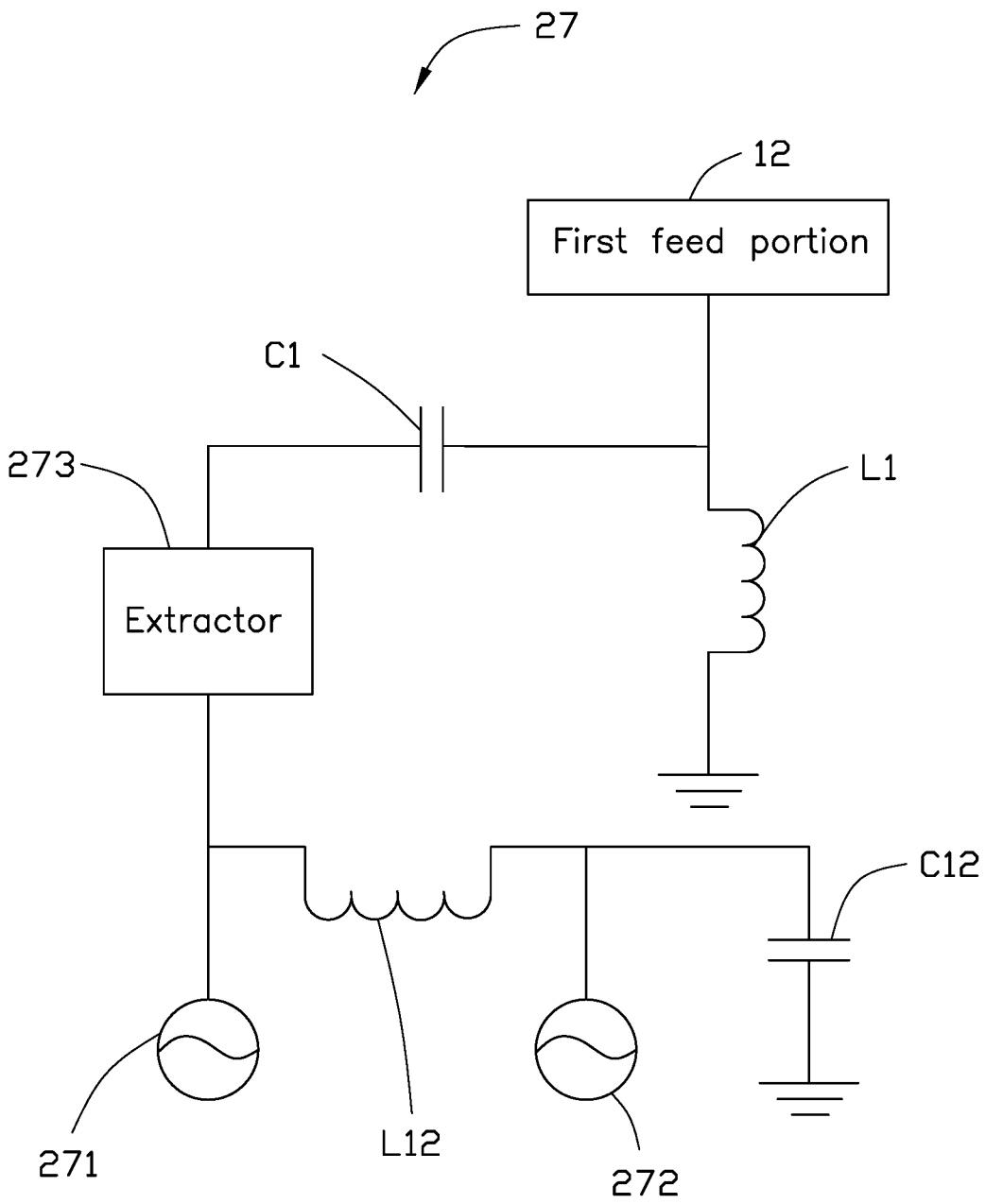
FIG. 5 is a circuit diagram of a first matching circuit of the antenna structure of FIG. 1.
Figure 6:
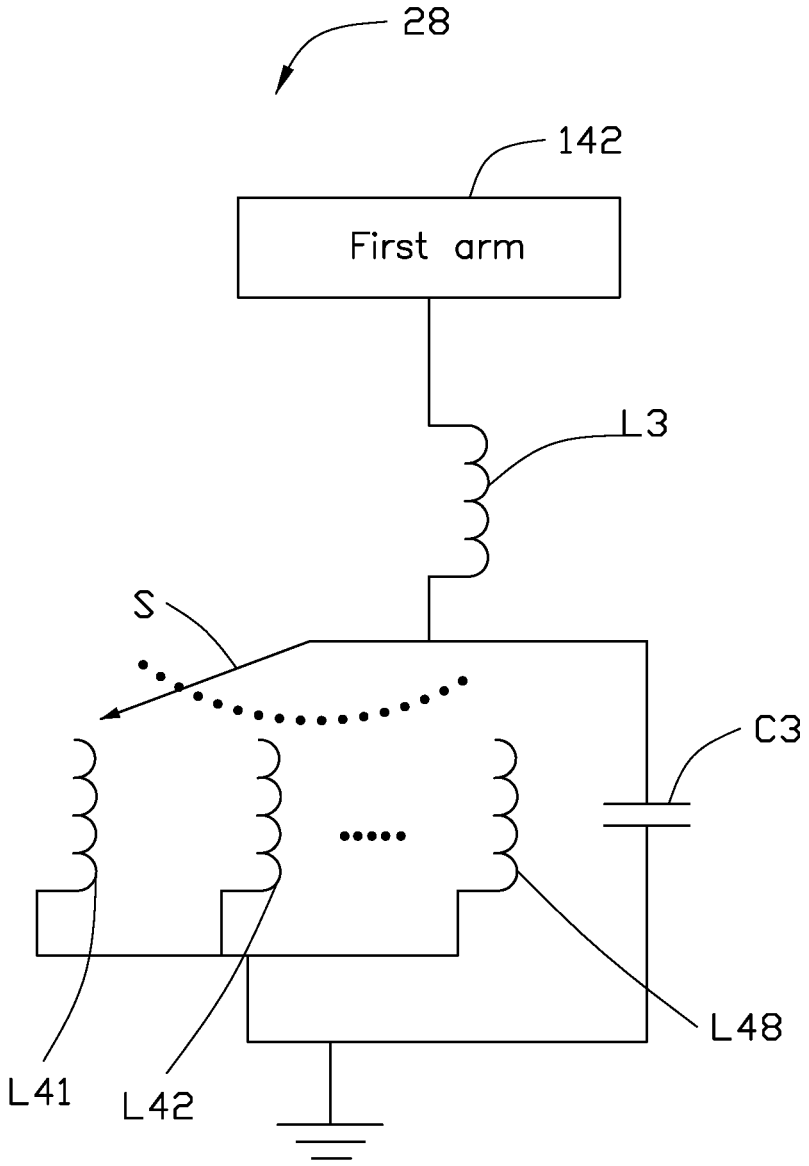
FIG. 6 is a circuit diagram of a second matching circuit of the antenna structure of FIG. 1.

Per FIG. 1, FIG. 2 and FIG. 3, the antenna structure 100 includes a metallic member 11, a first feed portion 12, a first ground portion 13, a first radiating portion 14, a second feed portion 15, a second ground portion 16, a second radiating portion 17, a third feed portion 18, a third ground portion 19, a first matching circuit 27 (shown in FIG. 5), and a second matching circuit 28 (shown in FIG. 6).

The metallic member 11 can be a metal housing of the wireless communication device 200. In this exemplary embodiment, the metallic member 11 is a frame structure and includes a front frame 111, a backboard 112, and a side frame 113. The front frame 111, the backboard 112, and the side frame 113 can be integral with each other. The front frame 111, the backboard 112, and the side frame 113 cooperatively form the metal housing of the wireless communication device 200. The front frame 111 defines an opening (not shown) thereon. The wireless communication device 200 includes a display 201. The display 201 is received in the opening. The display 201 has a display surface. The display surface is exposed at the opening and is positioned parallel to the backboard 112.

The backboard 112 is positioned opposite to the front frame 111. The backboard 112 is directly connected to the side frame 113, and there is no any gap between the backboard 112 and the side frame 113. The backboard 112 is an integral and single metallic sheet. The backboard 112 defines the holes 204, 205 for exposing a camera lens 202 and a receiver 203. The backboard 112 does not define any slot, break line, or gap for dividing the backboard 112. The backboard 112 serves as a ground of the antenna structure 100.

The side frame 113 is positioned between the front frame 111 and the backboard 112. The side frame 113 is positioned around a periphery of the front frame 111 and a periphery of the backboard 112. The side frame 113 forms a receiving space 114 together with the display 201, the front frame 111, and the backboard 112. The receiving space 114 can receive a print circuit board 210, a processing unit, or other electronic components or modules. In at least one embodiment, the electronic components or modules at least include the camera lens 202, the receiver 203, and a front camera 207. The camera lens 202, the receiver 203, and the front camera 207 are arranged on the print circuit board 210 and apart from each other.

The side frame 113 includes a top portion 115, a first side portion 116, and a second side portion 117. The top portion 115 connects the front frame 111 and the backboard 112. The first side portion 116 is positioned apart from and parallel to the second side portion 117. The top portion 115 has first and second ends. The first side portion 116 is connected to the first end of the first frame 111 and the second side portion 117 is connected to the second end of the top portion 115. The first side portion 116 connects the front frame 111 and the backboard 112. The second side portion 117 also connects the front frame 111 and the backboard 112. The side frame 113 defines a slot 118. In this exemplary embodiment, the slot 118 is defined at the top portion 115 and extends to the first side portion 116 and the second side portion 117. In other exemplary embodiments, the slot 118 can only be defined at the top portion 115 and does not extend to any one of the first side portion 116 and the second side portion 117. In other exemplary embodiments, the slot 118 can be defined only at the top portion 115, but not extending to any of the first side portion 116 and the second side portion 117. In other exemplary embodiments, the slot 118 can be defined at the top portion 115 and extends to one of the first side portion 116 and the second side portion 117.

The front frame 111 defines a first gap 1112 and a second gap 1114 at a top arm and a third gap 1116 and a four gap 1118 at two side arms, respectively. The third gap 1116 and the four gap 1118 are defined on opposite ends of the slot 118. The gaps 1112, 1114, 1116, 1118 communicate with the slot 118 and extend across the front frame 111. The gaps 1112, 1114, 1116 and 1118 separate a first radiating section 22, a second radiating section 24, and a third radiating section 26 from the front frame 111. In at least one embodiment, the first gap 1112 and the second gap 1114 are defined on the top arm of the front frame 111 adjacent to corners of opposite ends of the top arm, the first radiating section 22 is formed between the first gap 1112 and the second gap 1114. The second radiating section 24 is formed between the first gap 1112 and the third gap 1116 and extends from the top arm to a side arm of the front frame 111 and crosses an arc corner. The third radiating section 26 is formed between the second gap 1114 and the fourth gap 1118 and extends from the top arm to another side arm of the front frame 111 and crosses another arc corner. In this exemplary embodiment, the slot 118 and the gaps 1112, 1114, 1116, 1118 are filled with insulating material, for example, plastic, rubber, glass, wood, ceramic, or the like, thereby isolating the first radiating section 22, the second radiating section 24, the third radiating section 26, and the backboard 112.

In this exemplary embodiment, except for the slot 118 and the gaps 1112, 1114, 1116, 1118, an upper half portion of the front frame 111 and the side frame 113 does not define any other slot, break line, and/or gap. That is, there are only the gaps 1112, 1114, 1116, 1118 defined on the upper half portion of the front frame 111.

The first feed portion 12 is electrically connected to an end the first radiating section 22 adjacent to the second gap 1114, the other end of the first feed portion 12 electrically connects to feed sources 271, 272 (shown in FIG. 5) through the first matching circuit 27, thus the first feed portion 12 feeds in current for the first radiating section 22. In at least one embodiment, after the current is fed into the first feed portion 12, the current flows towards the first gap 1112 and the second gap 1114 along the first radiating section 22. Thus, the first radiating section 22 is divided into a long portion A1 towards the first gap 1112 and a short portion A2 towards the second gap 1114 according to a connecting point of the first feed portion 12. One end of the first ground portion 13 electrically connects to an end of the first radiating section 22 adjacent to the first gap 1112, the other end electrically connects to a ground through a fifth inductor L5 (shown in FIG. 4). The first ground portion 12 and the first ground portion 13 are both substantially L-shaped. In this exemplary embodiment, the connecting point of the first feed portion 12 is not positioned at a middle portion of the first radiating section 22. The long portion A1 is longer than the short portion A2.

The first marching circuit 27 is arranged on the print circuit board 210. Per FIG. 5, one end of the first marching circuit 27 electrically connects to the first feed portion 12, the other end electrically connects to a first feed source 271 and a second feed source 272. The first marching circuit 27 includes an extractor 273, a first inductor L1, a first capacitor C1, a second inductor L12, and a second capacitor C12. The first feed portion 12 electrically connects to the ground through the first inductor L1. One end of the extractor 273 is electrically connected between the first feed portion 12 and the first inductor L1 through the first capacitor C1, the other end is electrically connected to the ground through the second inductor L12 and the second capacitor C12. The first feed source 271 is electrically connected between the extractor 273 and the second inductor L12; the second feed source 272 is electrically connected between the second inductor L12 and the second capacitor C12. In this exemplary embodiment, the first feed source 271 is a diversity feed source, the second feed source 272 is a Global Positioning System (GPS) feed source. The long portion A1, the first feed portion 12, the first marching circuit 27, and the first ground portion 13 cooperatively activate a first mode to generate radiation signals in a first frequency band. In this exemplary embodiment, the first mode is an LTE-A (Long Term Evolution Advanced) high frequency operation mode, the first frequency band is a frequency band of about 2300-2690 MHz.

The first radiating portion 14 connects to the short portion A2 and the third radiating section 26. The first radiating portion 14 includes a first arm 142, a second arm 144, and a third arm 146 connected in that order. The first arm 142 is substantially U-shaped. The first arm 142 crosses the second gap 1114 to connect the short portion A2 and the third radiating section 26. The second arm 144 is substantially rectangular and has one end connected to the first arm 142, and extends towards the third radiating section 26. The third arm 146 is substantially L-shaped. One end of the third arm 146 connects to the second arm 144, the other end connects to the third radiating section 26.

The second matching circuit 28 is arranged on the printed circuit board 210. Per FIG. 6, one end of the second matching circuit 28 electrically connects to the first arm 142 of the first radiating portion 14, the other end electrically connects to the ground. The second matching circuit 28 includes a third inductor L3, a third capacitor C3, a switch S, and a plurality of fourth inductors L41, L42 . . . L48. One end of the third inductor L3 electrically connects to the first arm 142, the other end electrically connects to the ground through the third capacitor C3. One end of the switch S is electrically connected between the third inductor L3 and the third capacitor C3, the other end selectively connects to one end of one of the plurality of fourth inductors L41, L42 . . . L48. The other end of each of the plurality of fourth inductors L41, L42 . . . L48 electrically connects to the ground. The first matching circuit 27, the first feed portion 12, the short portion A2, the first arm 142 of the first radiating portion 14, and the third inductor L3 and the third capacitor C3 of the second matching circuit 28 cooperatively activate a second mode to generate radiation signals in a second frequency band. The first matching circuit 27, the first feed portion 12, the short portion A2, the third radiating section 26, the first radiating portion 14, and the third inductor L3 and one of the selectively connected fourth inductors L41, L42 . . . L48 cooperatively activate a third mode to generate radiation signals in a third frequency band. In this exemplary embodiment, the second mode includes an LTE-A middle frequency operation mode and a GPS mode, the second frequency band is a frequency band of about 1805-2170 MHz. The third mode is an LTE-A low frequency operation mode, the third frequency band is a frequency band of about 704-960 MHz. Through controlling the switch S, the short portion A2, the third radiating section 26, and the first radiating portion 14 can be switched to connect to different the fourth inductors L41, L42 . . . L48. Since each fourth inductor L41, L42 . . . L48 has a different impedance, the frequency band of the third mode can be adjusted. In this exemplary embodiment, the frequency band of the third mode can be offset towards a lower frequency or towards a higher frequency (relative to each other). Thus, the first matching circuit 27, the first feed portion 12, the short portion A2, the first arm 142 of the first radiating portion 14, the third inductor L3, and the third capacitor C3 feed in current from the diversity feed source 271 and the GPS feed source 272 to achieve functions of a diversity antenna and a GPS antenna.

The second feed portion 15 and the second ground portion 16 are both substantially L-shaped. The second feed portion 15 and the second ground portion 16 connect to an end of the second radiating section 24 adjacent to the first gap 1112. The second feed portion 15 and the second ground portion 16 are apart from each other. The second feed portion 15 is electrically connected between a WiFi 2.4G feed source and the second radiating section 24. The second ground portion 16 is electrically connected between the second radiating section 24 and the ground. The second feed portion 15, the second radiating section 24, and the second ground portion 16 cooperatively activate a fourth mode to generate radiation signals in a fourth frequency band. In this exemplary embodiment, the fourth mode is a WiFi 2.4G mode, the fourth frequency band is a frequency band of about 2400-2500 MHz.

The second radiating portion 17, the third feed portion 18, and the third ground portion 19 are substantially L-shaped. The third feed portion 18 and the third ground portion 19 electrically connect to an end of the second radiating portion 17. The third feed portion 18 and the third ground portion 19 are apart from each other. The second radiating portion 17 is received in a space surrounded by the receiver 203, the camera lens 207, and the long portion A1. The third feed portion 18 is electrically connected between a WiFi 5G feed source and the second radiating portion 17. The third feed portion 18, the second radiating portion 17, and the third ground portion 19 cooperatively activate a fifth mode to generate radiation signals in a fifth frequency band. In this exemplary embodiment, the fifth mode is a WiFi 5G mode, the fifth frequency band is a frequency band of about 5150-5825 MHz.

The backboard 112 serves as the ground of the antenna structure 100. Perhaps, a middle frame or a shielding mask also may serves as the ground of the antenna structure 100, the middle frame can be a shielding mask for shielding electromagnetic interference arranged on the display 201 facing to the backboard 112. The shielding mask or the middle frame can be made of metal material. The shielding mask or the middle frame may connect to the backboard 112 to form a greater ground for the antenna structure 100. In summary, each ground portion directly or indirectly connects to the ground.

In this exemplary embodiment, to obtain better antenna characteristic, a thickness of the wireless communication device 200 can be 7.43 millimeter. A width of the slot 118 can be 3.5 millimeter, that is a distance between the backboard 112 and the first radiating section 22, the second radiating section 24, and the third radiating section 26 can be 3.5 millimeter, thus to improve antenna characteristic for the radiating sections by apart from the backboard 112; the width of the slot 118 can be adjusted in a range of about 3-4.5 millimeter. A width of each of the gaps 1112, 1114, 1116, 1118 can be 2 millimeter, which may further improve antenna characteristic for the radiating sections; the width of each of the gaps 1112, 1114, 1116, 1118 can be adjusted in a range of about 1.5-2.5 millimeter.

In this exemplary embodiment, the second radiating portion 17 is apart from and arranged between the front camera 207 and the receiver 203. The first ground portion 13 is arranged apart from a side of the front camera 207. The first feed portion 12 is arranged apart from and between the camera lens 202 and the receiver 203. The first radiating portion 14 is arranged apart from a side of the camera lens 202 away from the first feed portion 12.

Figure 4:
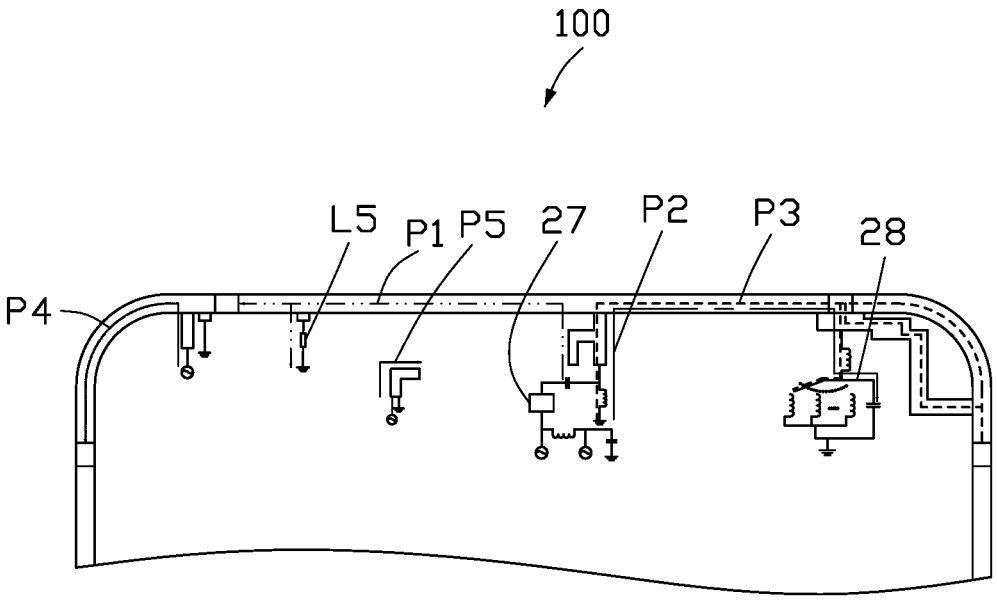
FIG. 4 is a current path distribution graph when the antenna structure of FIG. 1.

Per FIG. 4, when the current enters the first radiating section 22 from the first feed portion 12, the current flows towards two direction, one direction is flows through the long portion A1 and towards the first gap 1112 (please see a path P1), thus to activate the LTE-A high frequency mode. The current enters the first radiating section 22 from the first feed portion 12, the other direction is flows through the short portion A2 and towards the second gap 1114, and flows through the first arm 142 of the first radiating portion 14, the third inductor L3 and the third capacitor C3 of the second matching circuit 28 (please see a path P2), thus to activate the LTE-A middle frequency operation mode and the GPS mode. The current enters the first radiating section 22 from the first feed portion 12, the other direction is flows through the short portion A2, the first radiating portion 14, and the third radiating section 26, and towards the third gap 1116, meanwhile the current flows through the third inductor L3, the switch S, and one of the selectively connected fourth inductors L41, L42 . . . L48 (please see a path P3), thus to activate the LTE-A low frequency operation mode. When the current enters the second radiating section 24 from the second feed portion 15, the current flows through the second radiating section 24, the second ground portion 16, and towards the third gap 1116 (please see a path P4), thus to activate the WiFi 2.4G mode. When the current enters the second radiating portion 17 and the third ground portion 19 from the third feed portion 18 (please see a path P5), thus to activate the WiFi 5G mode.

Figure 7:
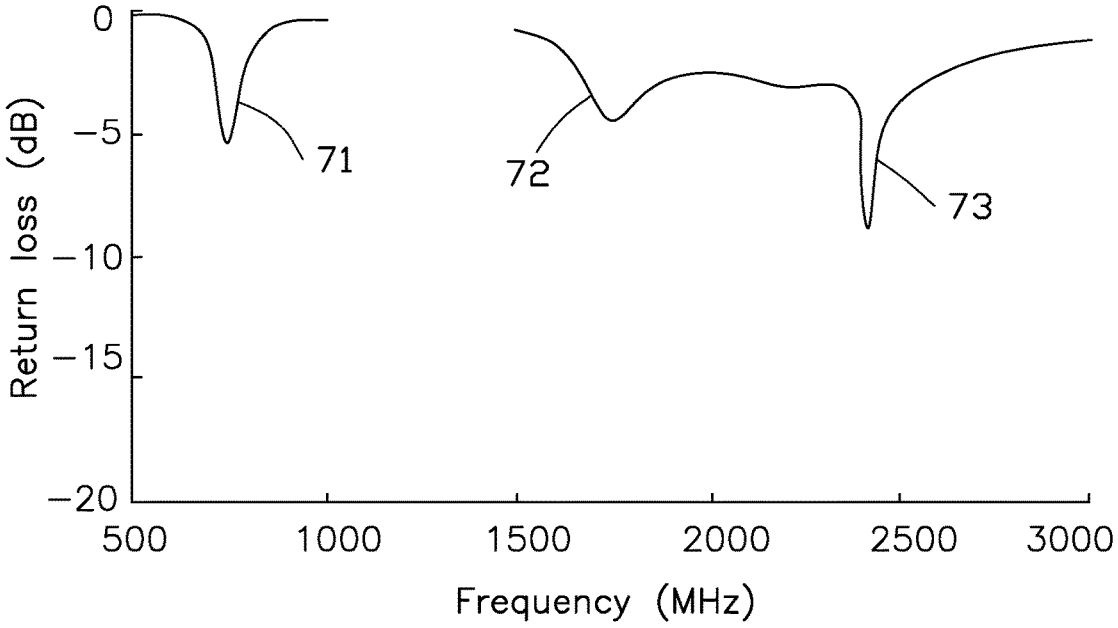
FIG. 7 is a return loss (RL) graph when a first radiating section, a third radiating section, and a first radiating portion of the antenna structure of FIG. 2 work.

FIG. 7 illustrates a return loss (RL) graph of the first radiating section 22, the third radiating section 26, and the first radiating portion 14 of the antenna structure 100 when working. Curve 71 illustrates a return loss when the antenna structure 100 works at the LTE-A low frequency band. Curve 72 illustrates a return loss when the antenna structure 100 works at the LTE-A middle frequency band. Curve 73 illustrates a return loss when the antenna structure 100 works at the LTE-A high frequency band.

Figure 8:
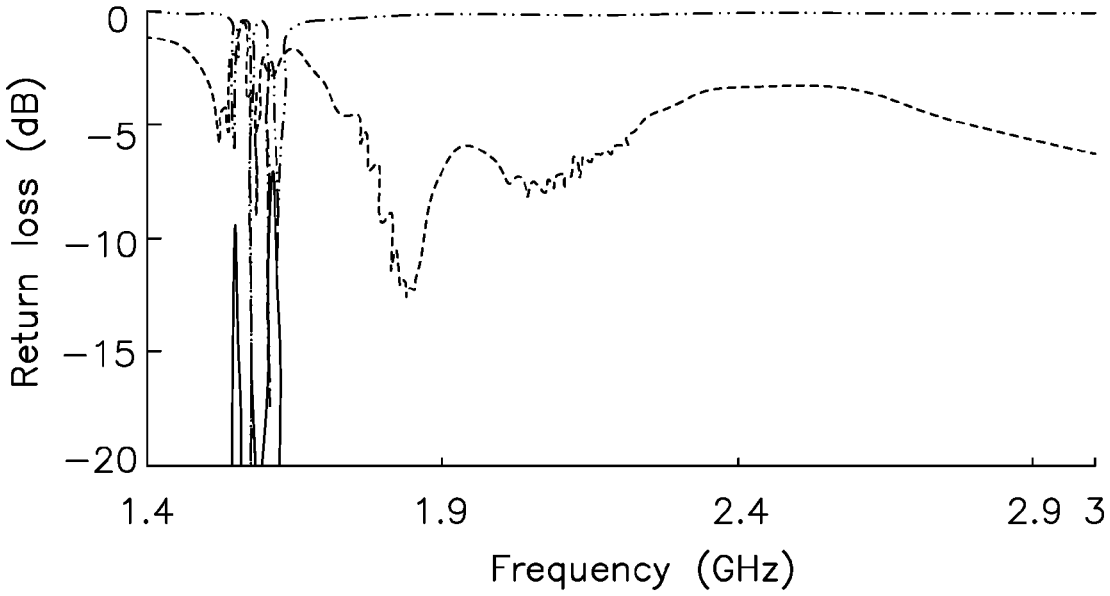
FIG. 8 is a return loss (RL) graph when the first radiating section, the third radiating section, and the first radiating portion of the antenna structure of FIG. 2 work through an extractor.

FIG. 8 illustrates a return loss (RL) graph of the first radiating section 22, the third radiating section 26, the first radiating portion 14, and the extractor 273 of the antenna structure 100 when works at GPS frequency band. A return loss when the antenna structure 100 having the extractor 273 of the first matching circuit 27 works at GPS frequency band may achieve an effect of 15 dB.

Figure 9:
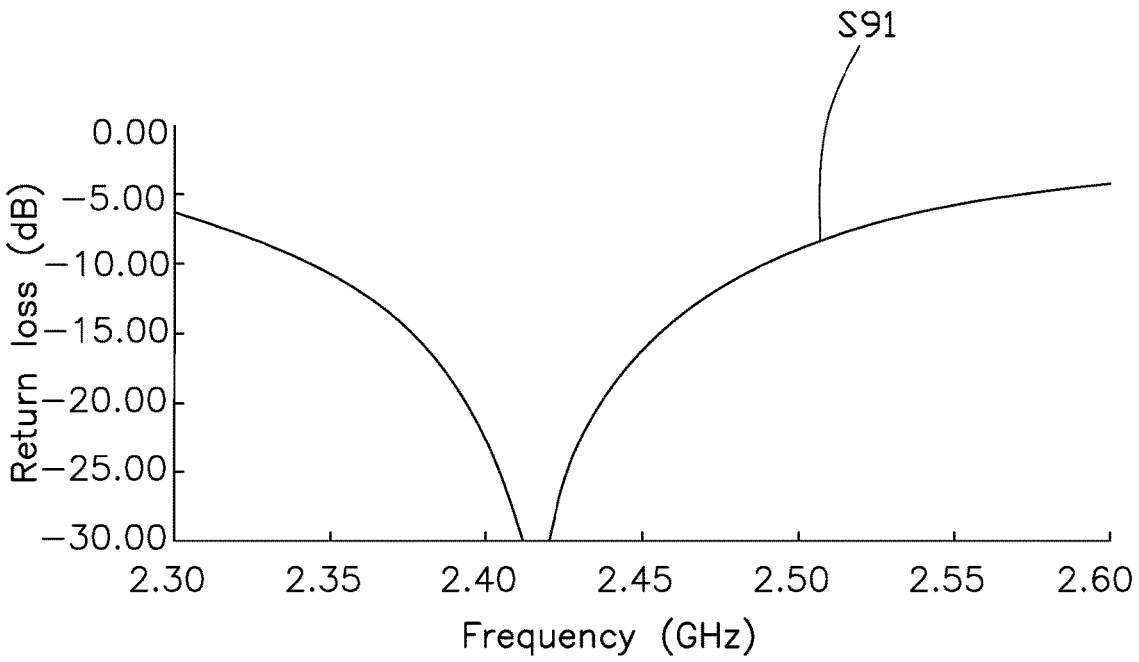
FIG. 9 is a return loss (RL) graph when a second radiating section of the antenna structure of FIG. 2 works.

FIG. 9 illustrates a return loss (RL) graph of the second radiating section 24 of the antenna structure 100 when working. Curve 91 illustrates a return loss when the antenna structure 100 works at the WiFi 2.4G frequency band (2400-2484 MHz).

Figure 10:
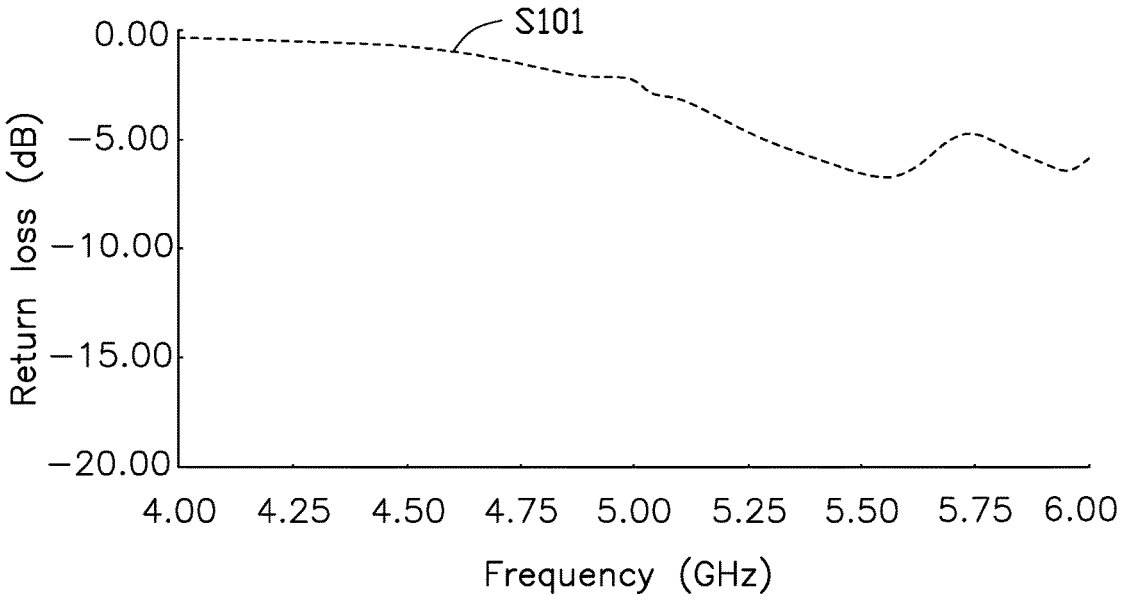
FIG. 10 is a return loss (RL) graph when a second radiating portion of the antenna structure of FIG. 2 works.

FIG. 10 illustrates a return loss (RL) graph of the second radiating portion 17 of the antenna structure 100 when working. Curve 101 illustrates a return loss when the antenna structure 100 works at the WiFi 5G frequency band (5150-5850 MHz).

Figure 11:
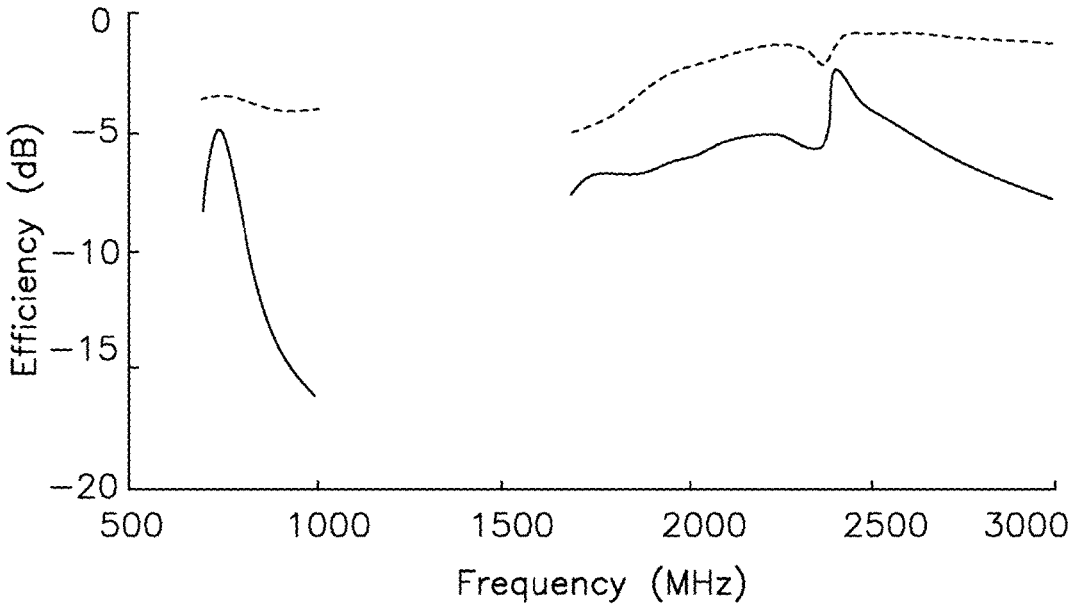
FIG. 11 is a radiating efficiency graph when the first radiating section, the third radiating section, and the first radiating portion of the antenna structure of FIG. 2 work.

FIG. 11 illustrates a radiating efficiency graph of the first radiating section 22, the third radiating section 26, and the first radiating portion 14 of the antenna structure 100 when working. The dotted line illustrates a radiating efficiency of the antenna structure 100; the solid line illustrates a total radiating efficiency of the antenna structure 100. The radiating efficiency of the antenna structure 100 at LTE-A low frequency band may be maintained in a range of about −7~−5 dB; the radiating efficiency of the antenna structure 100 at LTE-A middle frequency band and LTE-A high frequency band may be maintained in a range of about −6~−2.5 dB.

Figure 12:
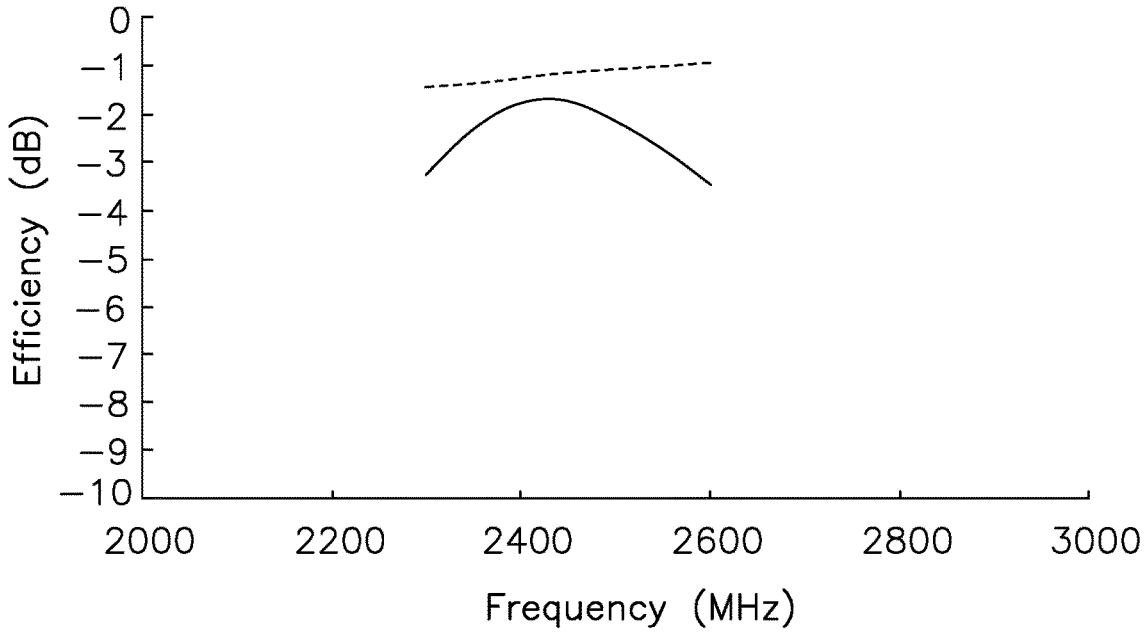
FIG. 12 is a radiating efficiency graph when the second radiating section of the antenna structure of FIG. 2 works.

FIG. 12 illustrates a radiating efficiency graph of the second radiating section 24 of the antenna structure 100 when working. The dotted line illustrates a radiating efficiency of the antenna structure 100; the solid line illustrates a total radiating efficiency of the antenna structure 100. The radiating efficiency of the antenna structure 100 at WiFi 2.4G frequency band may be maintained above −3 dB.

Figure 13:
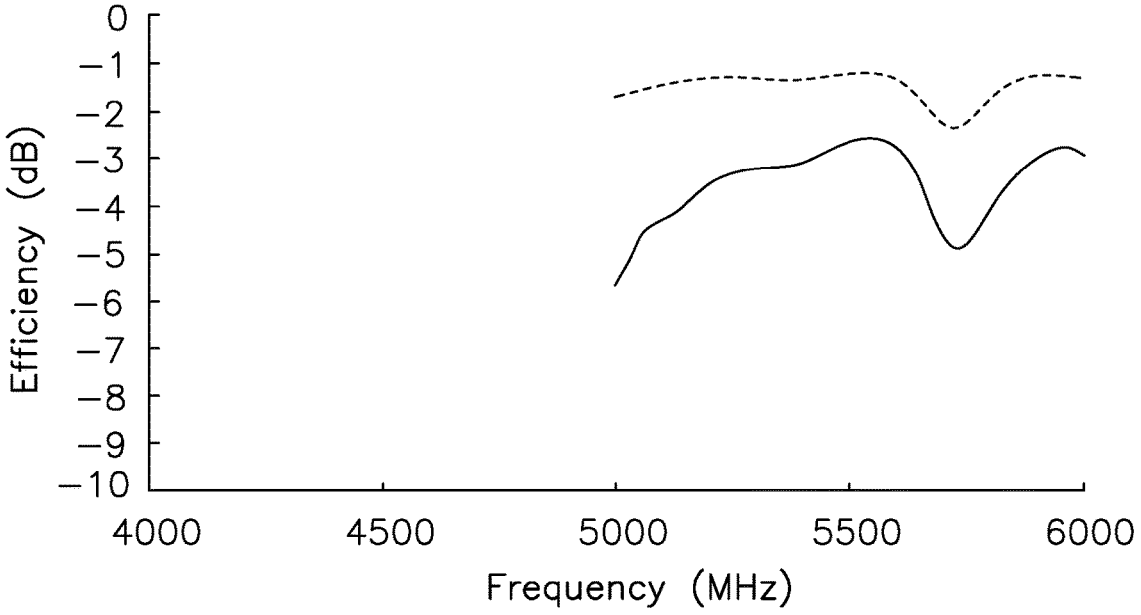
FIG. 13 is a radiating efficiency graph when the second radiating portion of the antenna structure of FIG. 2 works.

FIG. 13 illustrates a radiating efficiency graph of the second radiating portion 17 of the antenna structure 100 when working. The dotted line illustrates a radiating efficiency of the antenna structure 100; the solid line illustrates a total radiating efficiency of the antenna structure 100. The radiating efficiency of the antenna structure 100 at WiFi 5G frequency band may be maintained above −4 dB.

Figure 14:
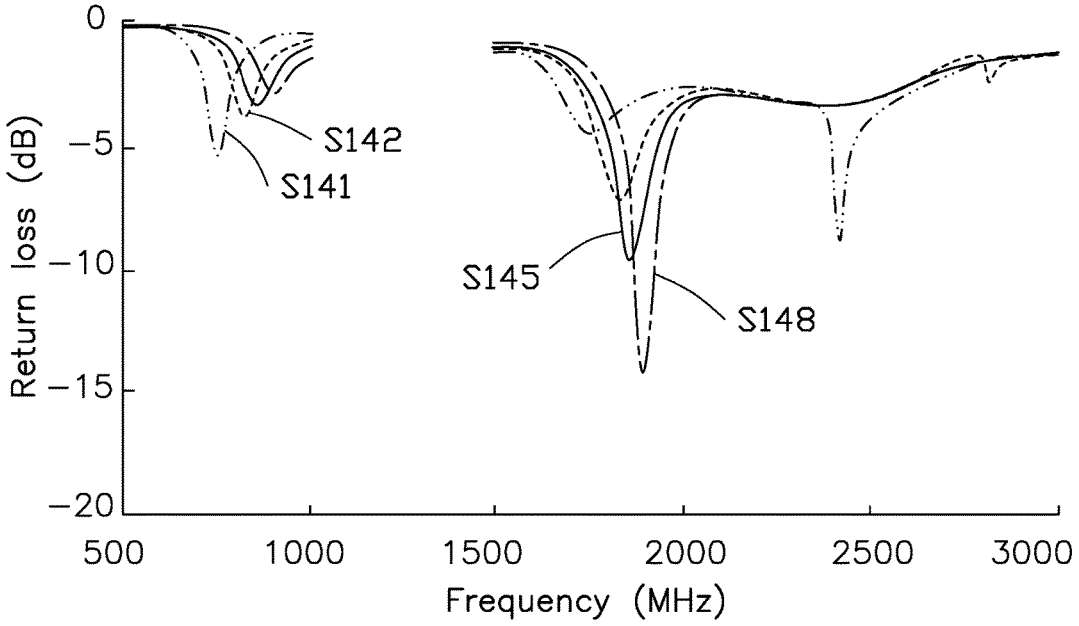
FIG. 14 is a return loss (RL) graph when the antenna structure of FIG. 2 works through switching the switch S to different fourth inductor L41, L42 . . . L48.

FIG. 14 illustrates a return loss (RL) graph of the antenna structure 100 having the switch S connected to different fourth inductor L41, L42, L45 . . . L48. Curve S141 illustrates a return loss of the antenna structure 100 having the switch S connected to the fourth inductor L41. Curve S142 illustrates a return loss of the antenna structure 100 having the switch S connected to the fourth inductor L42. Curve S145 illustrates a return loss of the antenna structure 100 having the switch S connected to the fourth inductor L45. Curve S148 illustrates a return loss of the antenna structure 100 having the switch S connected to the fourth inductor L48.

Per FIGS. 7 to 14, the antenna structure 100 can work at an LTE-A low frequency band (704-960 MHz), at an LTE-A middle frequency band (1805-2170 MHz), and at an LTE-A high frequency band (2300-2690 MHz). The antenna structure 100 can also work at the GPS frequency band (1575 MHz), WiFi 2.4G frequency band (2400-2500 MHz) and the WiFi 5G frequency band (5150-5825 MHz). That is, the antenna structure 100 can work at the low frequency band, the middle frequency band, and the high frequency band, and when the antenna structure 100 works at these frequency bands, a working frequency satisfies a design of the antenna and also has a good radiating efficiency.

The antenna structure 100 includes the metallic member 11 defining the slot on the side frame 113 and the gaps on the front frame 111, the backboard 112 is an integral and single metallic sheet without other slot, break line, and/or gap, which maintains an integrality and aesthetic.

Figure 15:
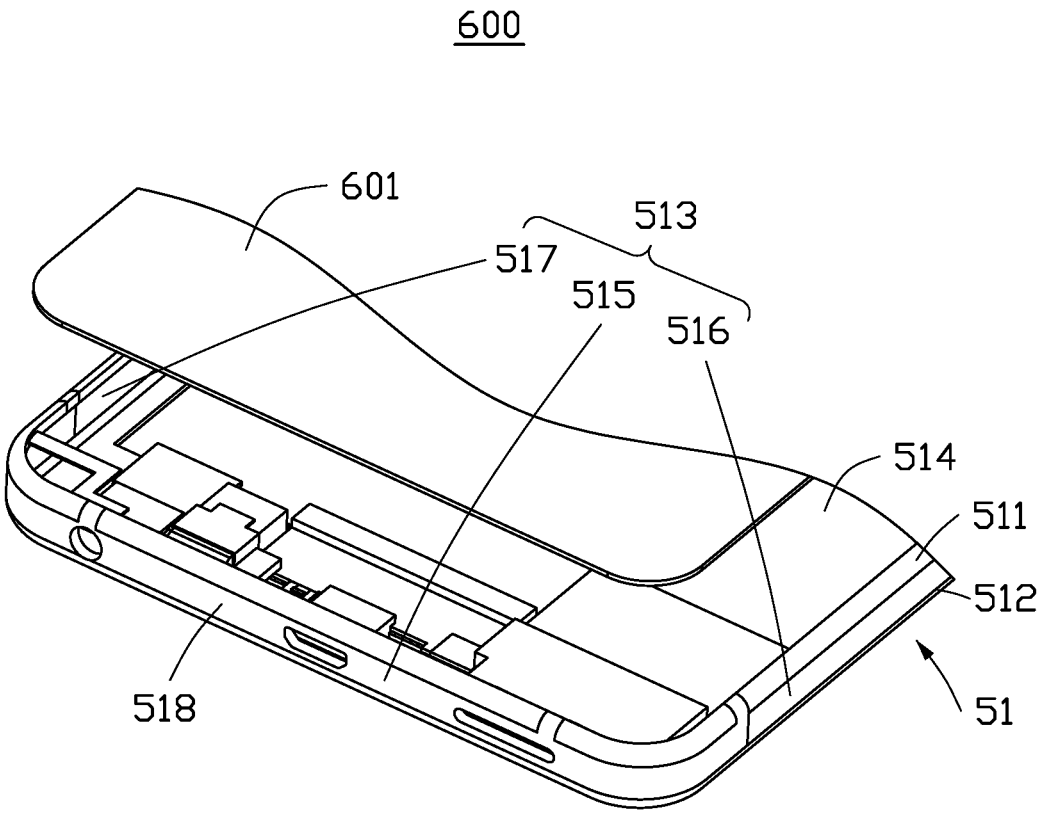
FIG. 15 is an isometric view of a second exemplary embodiment of a wireless communication device using a second exemplary antenna structure.

FIG. 15 illustrates a second embodiment of a wireless communication device 600 using a third exemplary antenna structure 500. The wireless communication device 600 can be a mobile phone or a personal digital assistant, for example. The antenna structure 500 can receive or send wireless signals.

Figure 16:
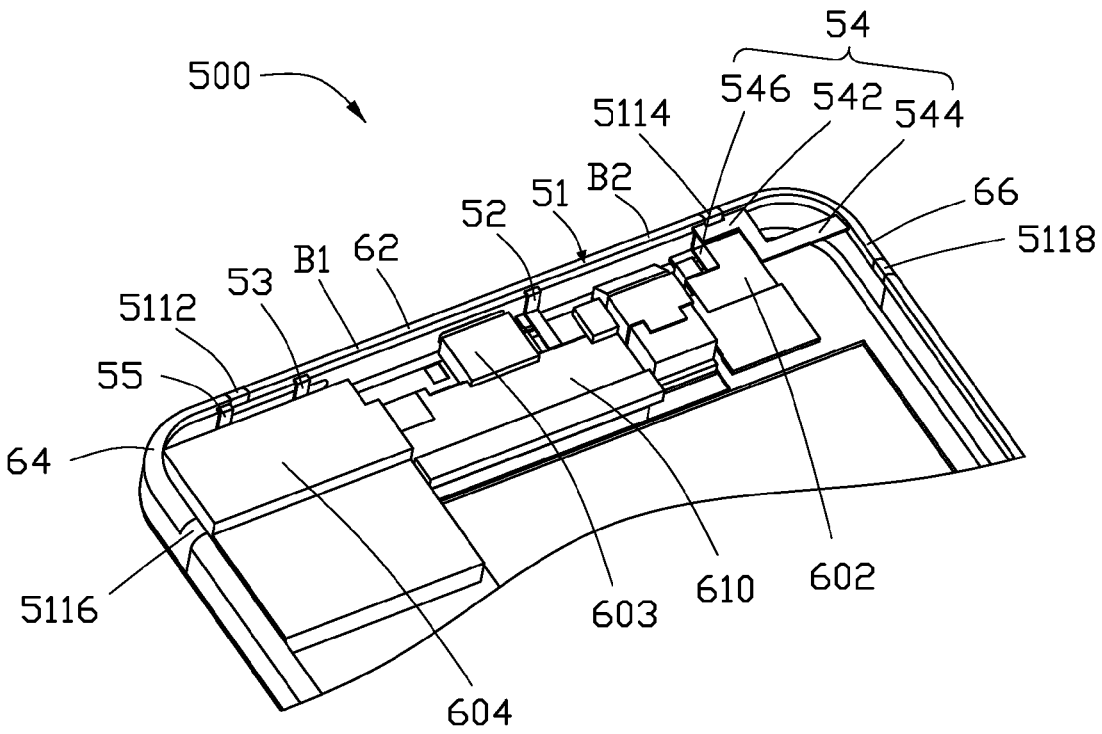
FIG. 16 is an assembled, isometric view of the wireless communication device of FIG. 15.
Figure 17:
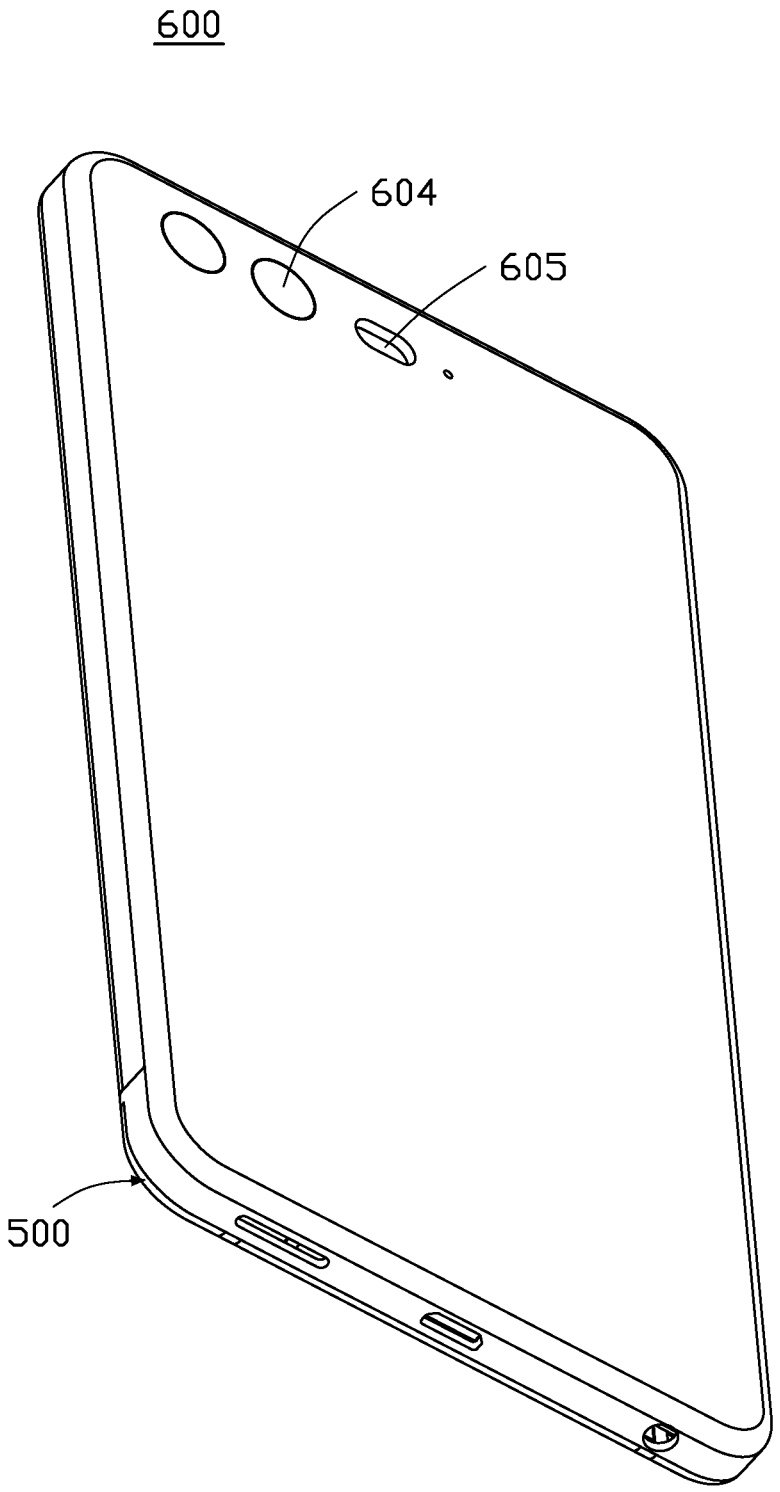
FIG. 17 is similar to FIG. 15, but shown in another angle.
Figure 18:
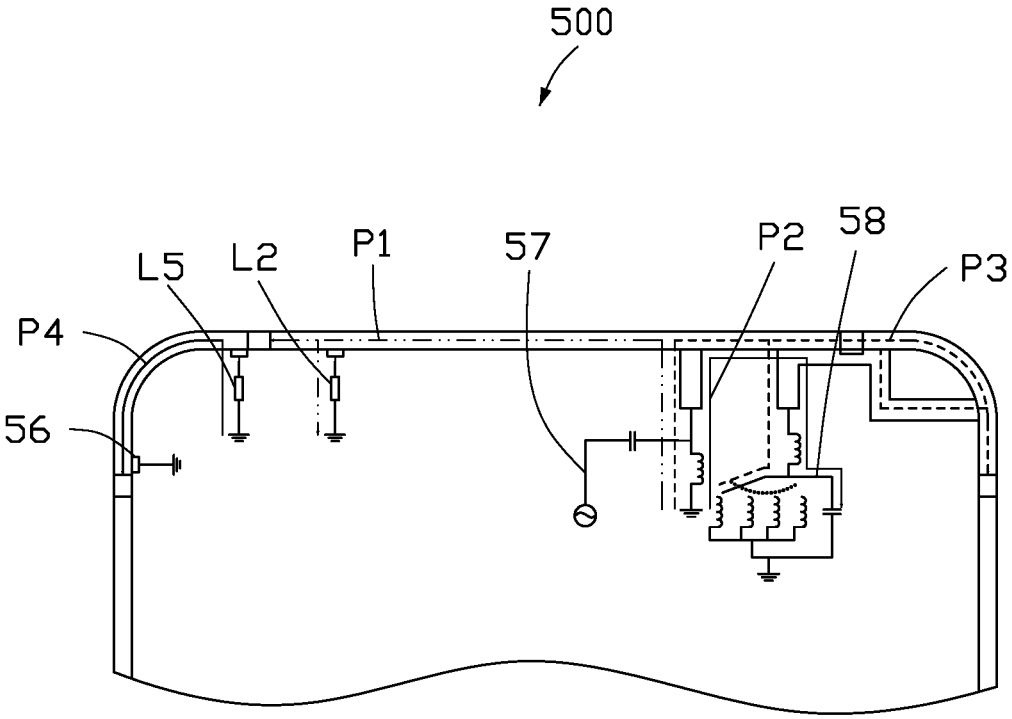
FIG. 18 is a current path distribution graph when the antenna structure of FIG. 16.

Per FIG. 15, FIG. 16 and FIG. 17, the antenna structure 500 includes a metallic member 51, a feed portion 52, a first ground portion 53, a radiating portion 54, a second ground portion 55, an extending section 55, a third ground portion 56 (shown in FIG. 18), a first matching circuit 57 (shown in FIG. 18), and a second matching circuit 58 (shown in FIG. 18).

The metallic member 51 can be a metal housing of the wireless communication device 600. In this exemplary embodiment, the metallic member 51 is a frame structure and includes a front frame 511, a backboard 512, and a side frame 513. The front frame 511, the backboard 512, and the side frame 513 can be integral with each other. The front frame 511, the backboard 512, and the side frame 513 cooperatively form the metal housing of the wireless communication device 600. The front frame 511 defines an opening (not shown) thereon. The wireless communication device 600 includes a display 601. The display 601 is received in the opening. The display 601 has a display surface. The display surface is exposed at the opening and is positioned parallel to the backboard 512.

The backboard 512 is positioned opposite to the front frame 511. The backboard 512 is directly connected to the side frame 513, and there is no any gap between the backboard 512 and the side frame 513. The backboard 512 is an integral and single metallic sheet. The backboard 512 defines holes for exposing a camera lens and a receiver. The backboard 512 does not define any slot, break line, or gap for dividing the backboard 512. The backboard 512 serves as a ground of the antenna structure 500.

The side frame 513 is positioned between the front frame 511 and the backboard 512. The side frame 513 is positioned around a periphery of the front frame 511 and a periphery of the backboard 512. The side frame 513 forms a receiving space 514 together with the display 601, the front frame 511, and the backboard 512. The receiving space 514 can receive a print circuit board 610, a processing unit, or other electronic components or modules. In at least one embodiment, the electronic components or modules at least include an audio jack 602, a USB connector 603, and a speaker 604. The audio jack 602, the USB connector 603, and the speaker 604 are arranged on the print circuit board 610 and apart from each other. The audio jack 602, the USB connector 603, and the speaker 604 are adjacent to the side frame 513.

The side frame 513 includes a bottom portion 515, a first side portion 516, and a second side portion 517. The bottom portion 515 connects the front frame 511 and the backboard 512. The first side portion 516 is positioned apart from and parallel to the second side portion 517. The bottom portion 515 has first and second ends. The first side portion 516 is connected to the first end of the first frame 311 and the second side portion 517 is connected to the second end of the bottom portion 515. The first side portion 516 connects the front frame 511 and the backboard 512. The second side portion 517 also connects the front frame 511 and the backboard 512. The side frame 513 defines a slot 518. In this exemplary embodiment, the slot 518 is defined at the bottom portion 515 and extends to the first side portion 516 and the second side portion 517. In other exemplary embodiments, the slot 518 can only be defined at the bottom portion 515 and does not extend to any one of the first side portion 516 and the second side portion 517. In other exemplary embodiments, the slot 518 can be defined only at the bottom portion 515, but not extending to any of the first side portion 516 and the second side portion 517. In other exemplary embodiments, the slot 518 can be defined at the bottom portion 515 and extends to one of the first side portion 516 and the second side portion 517.

The front frame 511 defines a first gap 5112 and a second gap 5114 at a bottom arm and a third gap 5116 and a four gap 5118 at two side arms, respectively. The third gap 5116 and the four gap 5118 are defined on opposite ends of the slot 518. The gaps 5112, 5114, 5116, 5118 communicate with the slot 518 and extend across the front frame 511. The gaps 5112, 5114, 5116 and 5118 separate a first radiating section 62, a second radiating section 64, and a third radiating section 66 from the front frame 511. In at least one embodiment, the first gap 5112 and the second gap 5114 are defined on the bottom arm of the front frame 511 adjacent to corners of opposite ends of the top arm, the first radiating section 62 is formed between the first gap 5112 and the second gap 5114. The second radiating section 64 is formed between the first gap 5112 and the third gap 5116 and extends from the top arm to a side arm of the front frame 511 and crosses an arc corner. The third radiating section 66 is formed between the second gap 5114 and the fourth gap 5118 and extends from the top arm to another side arm of the front frame 511 and crosses another arc corner. In this exemplary embodiment, the slot 518 and the gaps 5112, 5114, 5116, 5118 are filled with insulating material, for example, plastic, rubber, glass, wood, ceramic, or the like, thereby isolating the radiating section 62, the second radiating section 64, the third radiating section 66, and the backboard 512.

In this exemplary embodiment, except for the slot 518 and the gaps 5112, 5114, 5116, 5118, a lower half portion of the front frame 511 and the side frame 513 does not define any other slot, break line, and/or gap. That is, there are only the gaps 5112, 5114, 5116, 5118 defined on the lower half portion of the front frame 511.

Figure 19:
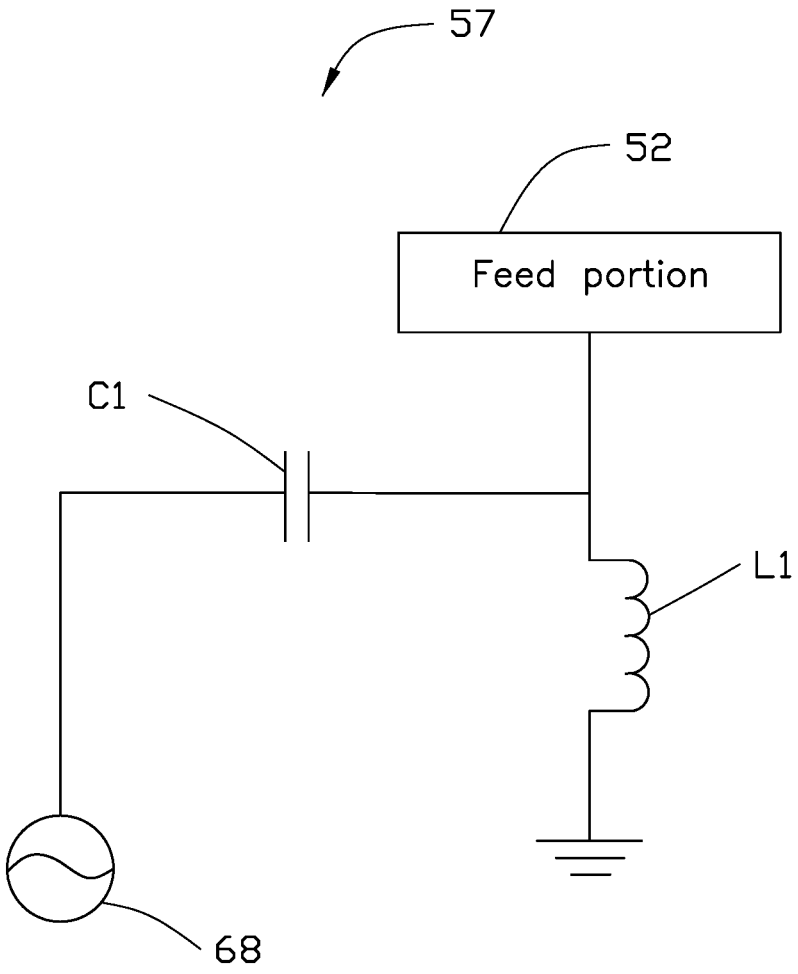
FIG. 19 is a circuit diagram of a first matching circuit of the antenna structure of FIG. 16.

One end of the feed portion 52 connects to the first radiating section 62, the other end electronically connects to a feed source 68 through the first matching circuit 57 (shown in FIG. 19). Thus, the feed source 68 feeds current into the first radiating section 62 through the first matching circuit 57 and the feed portion 52. In at least one embodiment, after the current is fed into the feed portion 52, the current flows towards the first gap 5112 and the second gap 5114 along the first radiating section 62. Thus, the first radiating section 62 is divided into a long portion B1 towards the first gap 5112 and a short portion B2 towards the second gap 5114 according to a connecting point of the feed portion 52. In this exemplary embodiment, the connecting point of the feed portion 52 is not positioned at a middle portion of the first radiating section 62. The long portion B1 is longer than the short portion B2.

The first ground portion 53 is electrically connected between the long portion B1 and a ground. The first ground portion 53 connects to an end of the first radiating section 62 adjacent to the first gap 5112. The first ground portion 53 and the feed portion 52 are substantially L-shaped. The feed portion 52 is positioned between the audio jack 602 and the USB connector 603, the first ground portion 53 is adjacent to the speaker 604.

The first matching circuit 57 is arranged on the printed circuit board 610. Per FIGS. 18 and 19, the first matching circuit 57 includes a first inductor L1 and a first capacitor C1. The feed portion 52 electrically connects to the ground through the first inductor L1. One end of the first capacitor C1 is electrically connected between the feed portion 52 and the first inductor L1, the other end electrically connects to a feed source 68. The first ground portion 53 electrically connects to the ground through a second inductor L2. The feed portion 52, the first matching circuit 57, the long portion B1, and the first ground portion 53 cooperatively activate a first mode to generate radiation signals in a first frequency band. In this exemplary embodiment, the first mode is an LTE-A (Long Term Evolution Advanced) middle frequency operation mode, the first frequency band is a frequency band of about 1710-2170 MHz.

The radiating portion 54 electrically connects to the short portion B2 and the third radiating section 66. The radiating portion 54 includes a first arm 542, a second arm 544, and a third arm 546. The first arm 542 is substantially U-shaped. The first arm 542 crosses the second gap 5114 and connects the short portion B2 and the third radiating section 66. The second arm 544 is substantially L-shaped. One end of the second arm 544 electrically connects to the first arm 542, the other end electrically connects to the third radiating section 66. The first arm 542 and the second arm 544 are in a same plane that is parallel to and apart from the backboard 512. One end of the third arm 546 perpendicularly connects to the first arm 542, the other end of the third arm 546 electrically connects to the backboard 512 through the second matching circuit 58.

Figure 20:
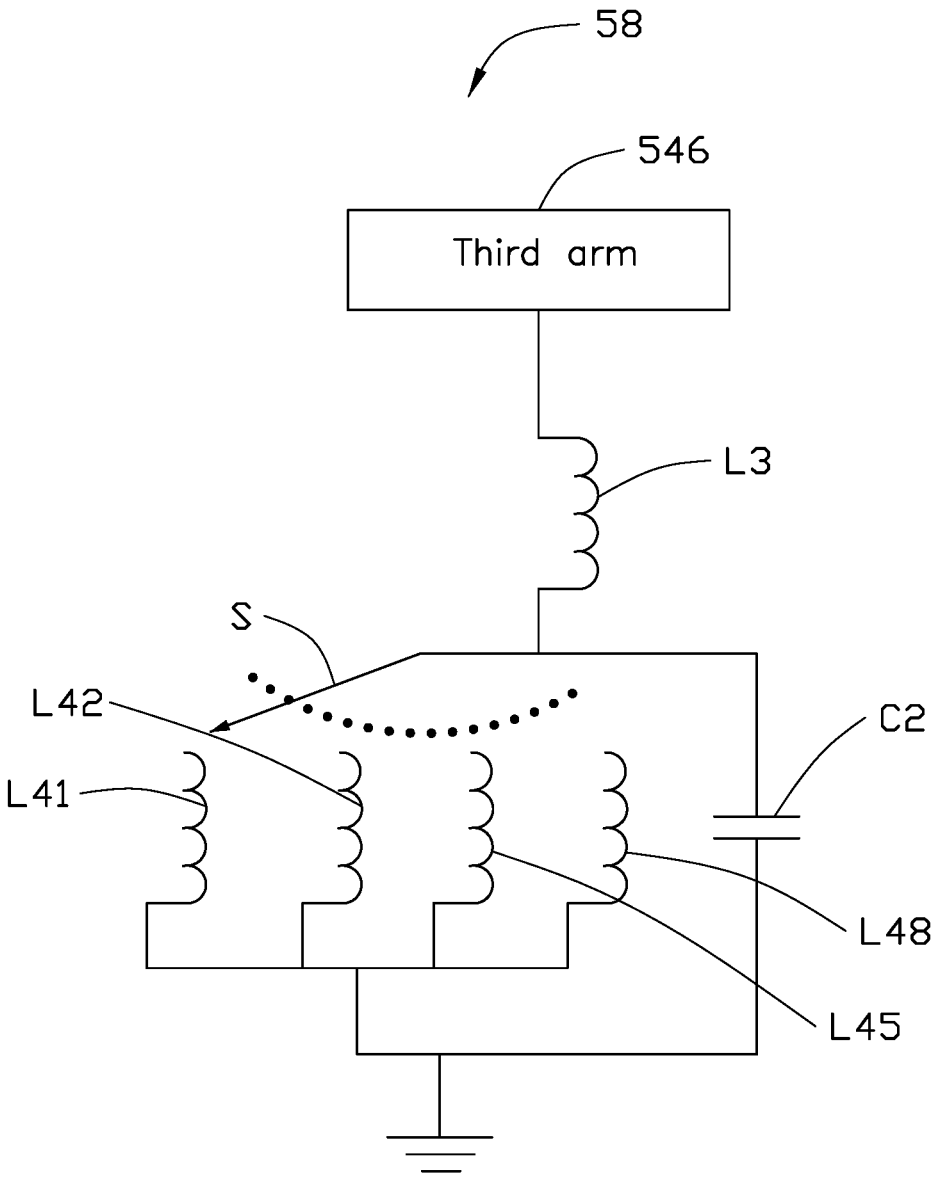
FIG. 20 is a circuit diagram of a second matching circuit of the antenna structure of FIG. 16.

The second matching circuit 58 is arranged on the printed circuit board 610. Per FIG. 20, the second matching circuit 58 includes a third inductor L3, a second capacitor C2, a switch S, and a plurality of fourth inductors L41, L42, L45 . . . L48. One end of the third inductor L3 electrically connects to the third arm 546 of the radiating portion 54, the other end electrically connects to the ground through the second capacitor C2. One end of the switch S is electrically connected between the third inductor L3 and the second capacitor C2, the other end of the switch S selectively connects to one end of one of the plurality of fourth inductors L41, L42, L45 . . . L48. The other end of each of the plurality of fourth inductors L41, L42, L45 . . . L48 electrically connects to the ground.

The first matching circuit 57, the feed portion 52, the short portion B2, the first arm 542 and the third arm 546 of the radiating portion 54, the third inductor L3, and the second capacitor C2 of the second matching circuit 58 cooperatively activate a second mode to generate radiation signals in a second frequency band. The first matching circuit 57, the feed portion 52, the short portion B2, the third radiating section 66, the radiating portion 54, the third inductor L3 and one of the selectively connected fourth inductors L41, L42, L45 . . . L48 cooperatively activate a third mode to generate radiation signals in a third frequency band. In this exemplary embodiment, the second mode is an LTE-A middle frequency operation mode the second frequency band is a frequency band of about 1805-2170 MHz. The third mode is an LTE-A low frequency operation mode, the third frequency band is a frequency band of about 704-960 MHz. Through controlling the switch S, the short portion B2, the third radiating section 66, and the radiating portion 54 can be switched to connect to different the fourth inductors L41, L42, L45 . . . L48. Since each fourth inductor L41, L42, L45 . . . L48 has a different impedance, the frequency band of the third mode can be adjusted. In this exemplary embodiment, the frequency band of the third mode can be offset towards a lower frequency or towards a higher frequency (relative to each other).

The second feed portion 55 is substantially L-shaped. One end of the second feed portion 55 electrically connects to an end of the second radiating section 64 adjacent to the first gap 5112, the other end electrically connects to the ground through a fifth inductor L5. One end of the third ground portion 56 (shown in FIG. 18) electrically connects to an end of the second radiating section 64 adjacent to the third gap 5116, the other end electrically connects to the ground. The second radiating section 64, the second feed portion 55, and the third ground portion 56 obtain current from the first radiating section 62 by coupling and thus to cooperatively activate a fourth mode to generate radiation signals in a fourth frequency band. In this exemplary embodiment, the fourth mode is an LTE-A high frequency operation mode, the fourth frequency band is a frequency band of about 2300-2700 MHz.

The backboard 512 serves as the ground of the antenna structure 500. Perhaps, a middle frame or a shielding mask also may serves as the ground of the antenna structure 100, the middle frame can be a shielding mask for shielding electromagnetic interference arranged on the display 601 facing to the backboard 512. The shielding mask or the middle frame can be made of metal material. The shielding mask or the middle frame may connect to the backboard 512 to form a greater ground for the antenna structure 500. In summary, each ground portion directly or indirectly connects to the ground.

In this exemplary embodiment, to obtain better antenna characteristic, a thickness of the wireless communication device 200 can be 7.43 millimeter. A width of the slot 518 can be 3.5 millimeter, that is a distance between the backboard 512 and the first radiating section 62, the second radiating section 64, and the third radiating section 66 can be 3.5 millimeter, thus to improve antenna characteristic for the radiating sections by apart from the backboard 512; the width of the slot 518 can be adjusted in a range of about 3-4.5 millimeter. A width of each of the gaps 5112, 5114, 5116, 5118 can be 2 millimeter, which may further improve antenna characteristic for the radiating sections; the width of each of the gaps 5112, 5114, 5116, 5118 can be adjusted in a range of about 1.5-2.5 millimeter.

In this exemplary embodiment, the feed portion 52 and the radiating portion 54 are on opposite sides of the audio jack 602. The feed portion 52 is positioned between the audio jack 602 and the USB connector 603. The first ground portion 53 and the second ground portion 55 are on a same side of the speaker 604.

Per FIG. 18, when the current enters the radiating section 62 from the feed portion 52, the current flows towards two direction, one direction is flows through the long portion B1 and towards the first gap 5112 and the first ground portion 53 (please see a path P1), thus to activate the LTE-A middle frequency operation mode (1710-2170 MHz). When the current enters the radiating section 62 from the feed portion 52, another direction is flows through the short portion B2 and towards the second gap 5114, and flows through the first arm 542 and the third arm 546 of the first radiating portion 54, the third inductor L3 and the second capacitor C2 of the second matching circuit 58 (please see a path P2), thus to activate the LTE-A middle frequency operation mode (1805-2170 MHz). Meanwhile, when the current enters the radiating section 62 from the feed portion 52, flows through the short portion B2, the first radiating portion 54, the third radiating section 66 and towards the fourth gap 5118, and further flows through the third inductor L3, the switch S, and one of the selectively connected fourth inductors L41, L42, L45 . . . L48 (please see a path P3), thus to activate the LTE-A low frequency operation mode (704-960 MHz). When the current enters the radiating section 62 from the feed portion 52, flows through the long portion B1 and towards the first gap 5112, the current is coupled to the second radiating section 64, the second ground portion 55, the third ground portion 56, and flows towards the third gap 5116 (please see a path P4), thus to activate the LTE-A high frequency operation mode (2300-2700 MHz).

Figure 21:
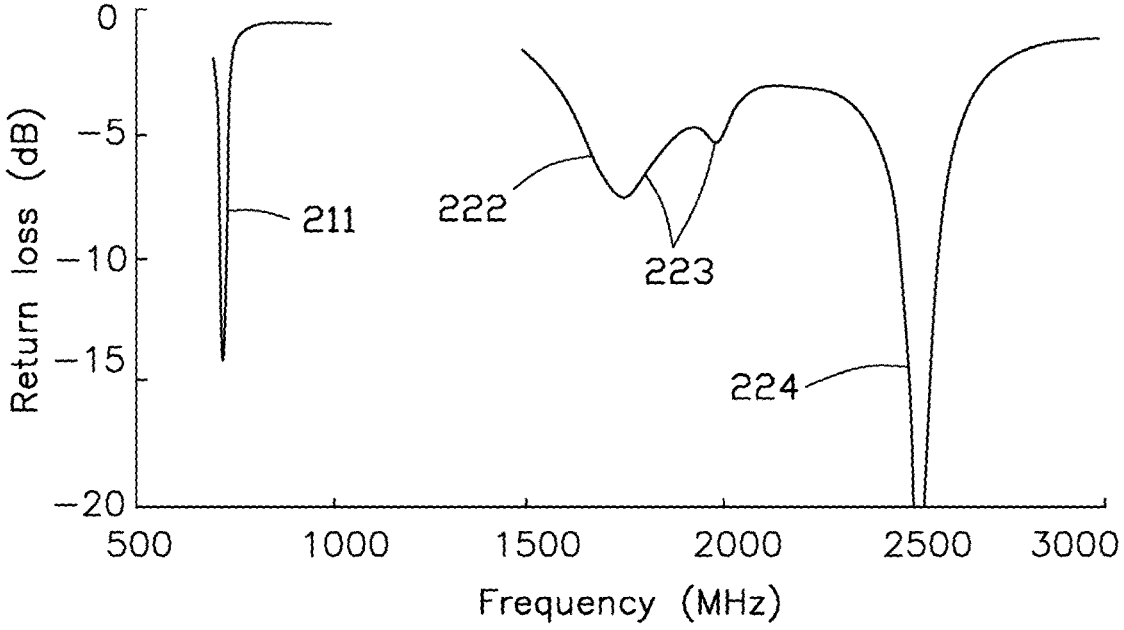
FIG. 21 is a return loss (RL) graph when the antenna structure of FIG. 16 works.

FIG. 21 illustrates a return loss (RL) graph of the antenna structure 500 when works at different frequencies bands. Curve 211 illustrates a return loss of the antenna structure 500 when works at LTE-A low frequency band; curve 212 illustrates a return loss of the antenna structure 500 when works at LTE-A middle frequency band of 1800 MHz; curve 213 illustrates a return loss of the antenna structure 500 when works at LTE-A middle frequency bands of 1700 MHz and 2100 MHz; curve 214 illustrates a return loss of the antenna structure 500 when works at LTE-A high frequency band of 2700 MHz.

Figure 22:
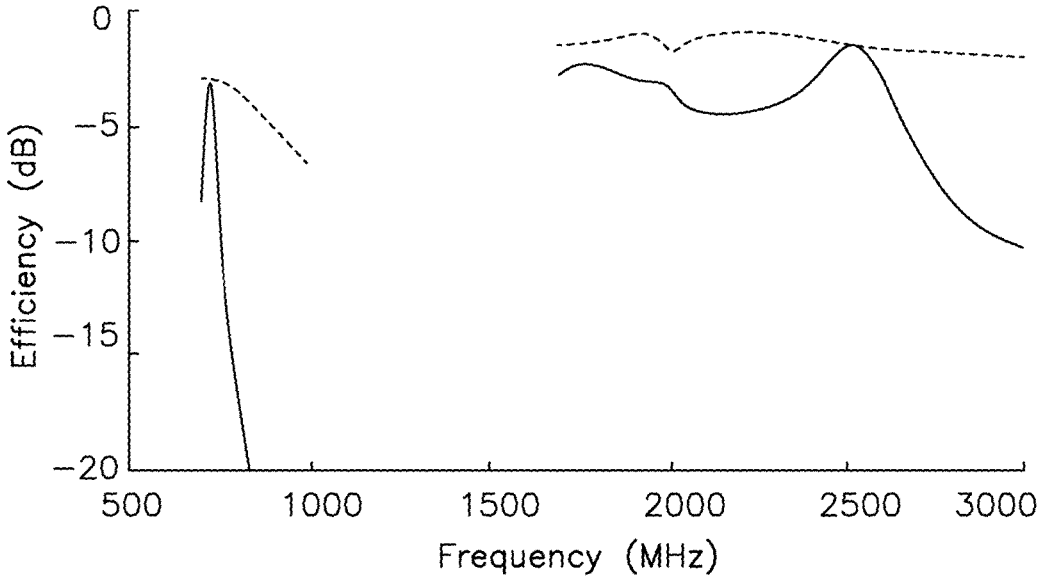
FIG. 22 is a radiating efficiency graph when the antenna structure of FIG. 16 works.

FIG. 22 illustrates a radiating efficiency graph of the antenna structure 500 when works at different frequency bands. The dotted line illustrates a radiating efficiency of the antenna structure 500; the solid line illustrates a total radiating efficiency of the antenna structure 500. The radiating efficiency of the antenna structure 500 at LTE-A low frequency band may be maintained in a range of about −5.5~−3 dB; the radiating efficiency of the antenna structure 500 at LTE-A middle frequency band and LTE-A high frequency band may be maintained in a range of about −5~−2 dB.

Figure 23:
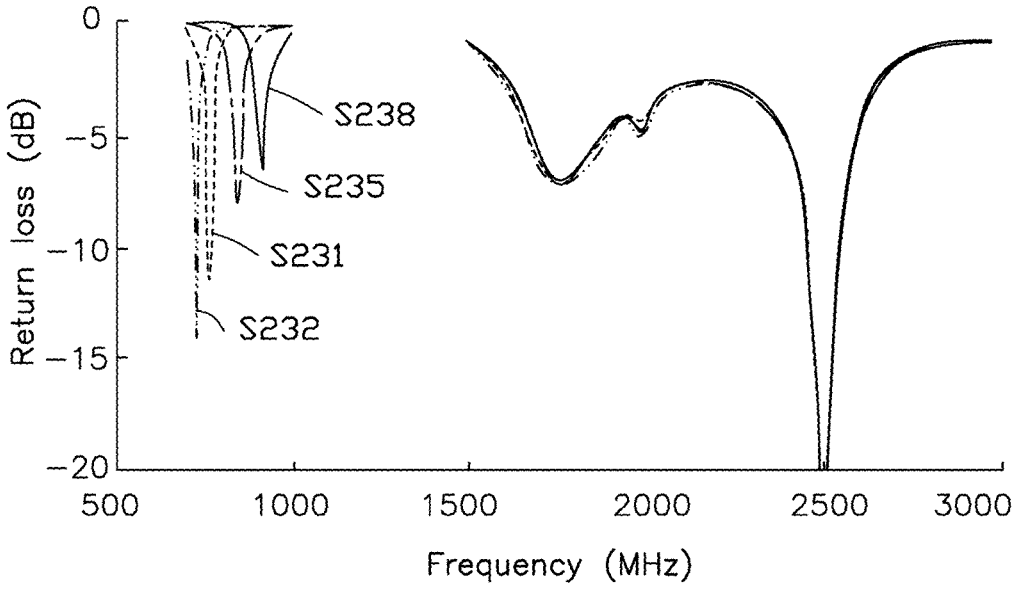
FIG. 23 is a return loss (RL) graph when the antenna structure of FIG. 16 works through switching the switch to different fourth inductors.

FIG. 23 illustrates a return loss (RL) graph of the antenna structure 500 having the switch S connected to different fourth inductor L41, L42, L45 . . . L48. Curve S231 illustrates a return loss of the antenna structure 500 having the switch S connected to the fourth inductor L41. Curve S232 illustrates a return loss of the antenna structure 500 having the switch S connected to the fourth inductor L42. Curve S235 illustrates a return loss of the antenna structure 500 having the switch S connected to the fourth inductor L45. Curve S238 illustrates a return loss of the antenna structure 500 having the switch S connected to the fourth inductor L48. In the LTE-A high frequency band, curves S231, S232, S235, S238 are substantially coincided, the antenna structure 500 has stable return loss when works in the LTE-A high frequency band.

Figure 24:
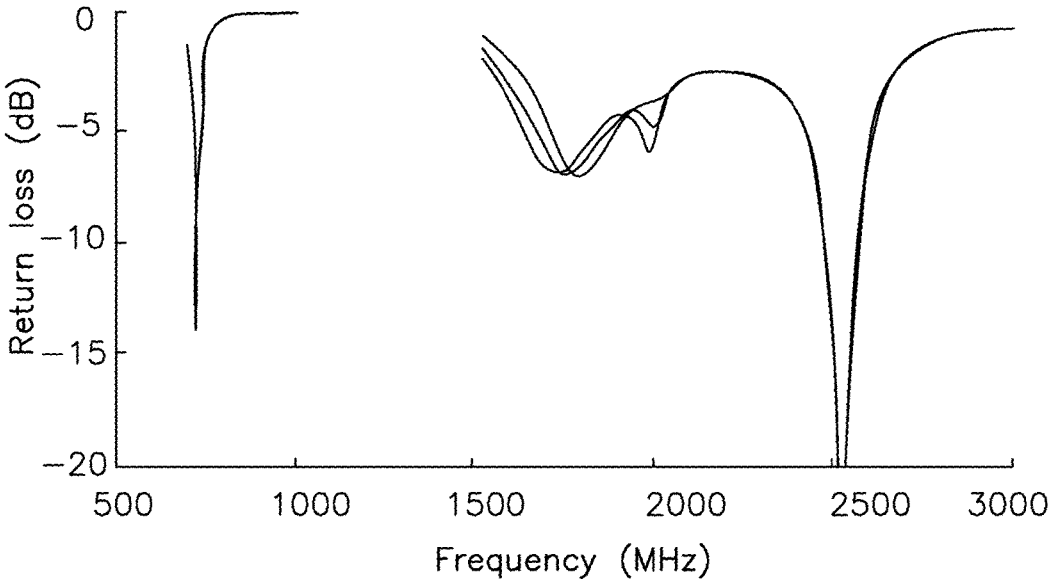
FIG. 24 is a return loss (RL) graph when the second matching circuit using a second capacitor with different capacitance values of the antenna structure of FIG. 16.

FIG. 24 illustrates a return loss (RL) graph of the antenna structure 500 having the second capacitor C2 with different capacitances. The LTE-A middle frequency band that the antenna structure 500 works at can be adjusted by the second capacitor C2 with different capacitances.

The antenna structure 500 can work at the LTE-A low frequency band (704-960 MHz), at the LTE-A middle frequency band (1710-2170 MHz), at another LTE-A middle frequency band (1850-2170 MHz), and at the LTE-A high frequency band (2300-2700 MHz), and when the antenna structure 500 works at these frequency bands, a working frequency satisfies a design of the antenna and also has a good radiating efficiency.

The antenna structure 500 includes the metallic member 51 defining the slot on the side frame 513 and the gaps on the front frame 511, the backboard 512 is an integral and single metallic sheet without other slot, break line, and/or gap, which maintains an integrality and aesthetic.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a metallic member, the metallic member comprising a front frame, a backboard, and a side frame, the side frame being between the front frame and the backboard;

a first feed portion;

a first matching circuit comprising an extractor; and a second matching circuit comprising a third inductor and a third capacitor;

wherein the side frame defines a slot;

wherein the front frame defines a first gap and a second gap, the first gap and the second gap are between two opposite ends of the slot, the first gap and the second gap communicate with the slot and extend across the front frame; and wherein a portion of the front frame between the first gap and the second gap forms a first radiating section, one end of the first feed portion electrically connects to the first radiating section, the other end of the first feed portion connects to a first feed source and a second feed source through the extractor; an end of the first radiating section adjacent to the second gap connects to a ground through the third inductor and the third capacitor.

2. The antenna structure of claim 1, wherein the slot and the gaps are all filled with insulating material.

3. The antenna structure of claim 1, wherein the side frame comprises at least a top portion, a first side portion, and a second side portion, the first side portion and the second side portion are respectively connected to two ends of the top portion, the slot extends from the top portion to the first side portion and the second side portion of the side frame, the front frame further defines a third gap and a fourth gap, the third gap and the fourth gap are on the two opposite ends of the slot.

4. The antenna structure of claim 3, wherein the first gap, the second gap, the third gap, and the fourth gap separate the first radiating section, a second radiating section, and a third radiating section from the front frame; the second radiating section is formed between the first gap and the third gap and extends from a top arm to a side arm of the front frame; the third radiating section is formed between the second gap and the fourth gap and extends from the top arm to another side arm of the front frame.

5. The antenna structure of claim 4, wherein the first radiating section is divided into a long portion and a short portion by a connecting point of the first feed portion, the long portion extends towards the first gap and the short portion extends towards the second gap from the connecting point of the first feed portion; the long portion is longer than the short portion.

6. The antenna structure of claim 5, further comprising a first ground portion, wherein one end of the first ground portion electrically connects to an end of the first radiating section adjacent to the first gap, the other end of the first ground portion electrically connects to the ground.

7. The antenna structure of claim 6, wherein the first marching circuit further includes a first inductor, a first capacitor, a second inductor, and a second capacitor; the first feed portion electrically connects to the ground through the first inductor; one end of the extractor is electrically connected between the first feed portion and the first inductor through the first capacitor, the other end of the extractor is electrically connected to the ground through the second inductor and the second capacitor; the first feed source is electrically connected between the extractor and the second inductor; the second feed source is electrically connected between the second inductor and the second capacitor.

8. The antenna structure of claim 7, wherein the first feed source is a diversity feed source, the second feed source is a Global Positioning System (GPS) feed source; the long portion, the first feed portion, the first marching circuit, and the first ground portion cooperatively activate a first mode to generate radiation signals in a first frequency band, the first mode is an LTE-A (Long Term Evolution Advanced) high frequency operation mode, the first frequency band is a frequency band of about 2300-2690 MHz.

9. The antenna structure of claim 8, further comprising a first radiating portion, wherein the first radiating portion includes a first arm, a second arm, and a third arm connected in that order; the first arm crosses the second gap to connect the short portion and the third radiating section; the second arm has one end connected to the first arm and extends towards the third radiating section; one end of the third arm connects to the second arm, the other end of the third arm connects to the third radiating section.

10. The antenna structure of claim 9, wherein the second matching circuit further includes a switch and a plurality of fourth inductors; one end of the third inductor electrically connects to the first arm, the other end of the third inductor electrically connects to the ground through the third capacitor; one end of the switch is electrically connected between the third inductor and the third capacitor, the other end of the switch selectively connects to one end of one of the plurality of fourth inductors; the other end of each of the plurality of fourth inductors electrically connects to the ground.

11. The antenna structure of claim 10, wherein the first matching circuit, the first feed portion, the short portion, the first arm of the first radiating portion, and the third inductor and the third capacitor of the second matching circuit cooperatively activate a second mode to generate radiation signals in a second frequency band; the first matching circuit, the first feed portion, the short portion, the third radiating section, the first radiating portion, and the third inductor and one of the selectively connected fourth inductors cooperatively activate a third mode to generate radiation signals in a third frequency band.

12. The antenna structure of claim 11, wherein the second mode comprises an LTE-A middle frequency operation mode and a GPS mode, the second frequency band is a frequency band of about 1805-2170 MHz; the third mode is an LTE-A low frequency operation mode, the third frequency band is a frequency band of about 704-960 MHz.

13. The antenna structure of claim 12, wherein through controlling the switch, the short portion, the third radiating section, and the first radiating portion is switched to connect to different fourth inductors; since each fourth inductor has a different impedance, the frequency band of the third mode is adjusted towards a lower frequency or towards a higher frequency.

14. The antenna structure of claim 4, further comprising a second feed portion and a second ground portion, wherein the second feed portion and the second ground portion connect to an end of the second radiating section adjacent to the first gap, the second feed portion and the second ground portion are apart from each other; the second feed portion is electrically connected between a WiFi 2.4G feed source and the second radiating section; the second ground portion is electrically connected between the second radiating section and the ground.

15. The antenna structure of claim 14, wherein the second feed portion, the second radiating section, and the second ground portion cooperatively activate a fourth mode to generate radiation signals in a fourth frequency band, the fourth mode is a WiFi 2.4G mode, the fourth frequency band is a frequency band of about 2400-2500 MHz.

16. The antenna structure of claim 4, wherein a width of the slot is in a range from 3 to 4.5 millimeter, that is, a distance between the backboard and the first radiating section, the second radiating section, and the third radiating section is in a range from 3 to 4.5 millimeter; a width of each of the gaps is in a range from 1.5 to 2.5 millimeter.

17. The antenna structure of claim 1, further comprising a second radiating portion, a third feed portion, and a third ground portion, wherein the third feed portion and the third ground portion electrically connect to an end of the second radiating portion, the third feed portion and the third ground portion are apart from each other; the third feed portion is electrically connected between a WiFi 5G feed source and the second radiating portion.

18. The antenna structure of claim 17, wherein the third feed portion, the second radiating portion, and the third ground portion cooperatively activate a fifth mode to generate radiation signals in a fifth frequency band, the fifth mode is a WiFi 5G mode, the fifth frequency band is a frequency band of about 5150-5825 MHz.

19. The antenna structure of claim 1, wherein the backboard is directly connected to the side frame and there is no any gap between the backboard and the side frame, the backboard is an integral and single metallic sheet, the backboard does not define any slot, break line, or gap for dividing the backboard.

20. A wireless communication device, comprising:

an antenna structure, the antenna structure comprising:

a metallic member, the metallic member comprising a front frame, a backboard, and a side frame, the side frame being positioned between the front frame and the backboard;

a first feed portion;

a first matching circuit comprising an extractor; and a second matching circuit comprising a third inductor and a third capacitor;

wherein the side frame defines a slot;

wherein the front frame defines a first gap and a second gap, the first gap and the second gap are between two opposite ends of the slot, the first gap and the second gap communicate with the slot and extend across the front frame; and wherein a portion of the front frame between the first gap and the second gap forms a first radiating section, one end of the first feed portion electrically connects to the first radiating section, the other end of the first feed portion connects to a first feed source and a second feed source through the extractor; an end of the first radiating section adjacent to the second gap connects to a ground through the third inductor and the third capacitor.

* * * * *